US011724865B2

(12) United States Patent
Tomioka

(10) Patent No.: US 11,724,865 B2
(45) Date of Patent: Aug. 15, 2023

(54) TOILET ROLL PACKAGE

(71) Applicant: Daio Paper Corporation, Ehime (JP)

(72) Inventor: Noritada Tomioka, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 0 days.

(21) Appl. No.: 17/762,070

(22) PCT Filed: Sep. 23, 2020

(86) PCT No.: PCT/JP2020/035744

§ 371 (c)(1),
(2) Date: Mar. 20, 2022

(87) PCT Pub. No.: WO2021/065602

PCT Pub. Date: Apr. 8, 2021

(65) Prior Publication Data

US 2022/0371801 A1 Nov. 24, 2022

(30) Foreign Application Priority Data

Oct. 1, 2019 (JP) ..... 2019-181736

(51) Int. Cl.
*B65D 75/12* (2006.01)
*B65D 75/58* (2006.01)
(Continued)

(52) U.S. Cl.
CPC ..... *B65D 75/12* (2013.01); *B65D 75/5833* (2013.01); *B65D 77/04* (2013.01); *B65D 85/672* (2013.01); *B65D 2577/043* (2013.01)

(58) Field of Classification Search
CPC ..... B65D 71/06; B65D 71/063; B65D 75/12; B65D 75/52; B65D 75/56; B65D 75/566;
(Continued)

(56) References Cited

U.S. PATENT DOCUMENTS 4,765,474 A * 8/1988 James ..... B65D 75/566 206/391
5,622,309 A 4/1997 Matsuda et al.
(Continued)

FOREIGN PATENT DOCUMENTS

JP 2591646 Y2 5/1995
JP 8-217061 A 8/1996
(Continued)

*Primary Examiner* — Bryon P Gehman
(74) *Attorney, Agent, or Firm* — Renner, Kenner; Arthur M. Reginelli

(57) ABSTRACT

Provided is a toilet roll package wherein toilet rolls are gusseted-packaged with exterior film, each roll being individually wrapped with resin film. The rolls are arranged in two rows between upper and lower sealed portions of the package with their circumferential surfaces abutting, the upper and lower sealed portions facing to the circumferential surfaces of the rolls. In an area of the exterior film closer to the upper sealed portion than position (P1) of adjoining between the rolls closest to the upper sealed portion, open start portion (60) convexed toward the upper sealed portion is formed. The open start portion (60) includes base portion (61) having an easy tear line extending along the top-bottom direction, and flaring portion (62) formed with easy tear lines flaring from close to a lateral side of the base portion toward the lower sealed portion with gradually increasing distance therebetween.

10 Claims, 6 Drawing Sheets

(51) Int. Cl.
*B65D 77/04* (2006.01)
*B65D 85/672* (2006.01)

(58) Field of Classification Search
CPC .... B65D 75/58; B65D 75/5827; B65D 79/00; B65D 2571/0045; B65D 2571/00574; B65D 75/5833; B65D 77/04; B65D 85/672
USPC ..... 206/391–394, 494, 497
See application file for complete search history.

(56) References Cited

U.S. PATENT DOCUMENTS

| | | | | |
|---|---|---|---|---|
| 7,971,717 | B2 * | 7/2011 | Eilert | B65D 75/5816 206/391 |
| 8,256,616 | B2 * | 9/2012 | Eilert | B65D 75/5827 206/391 |
| 2007/0084741 | A1 * | 4/2007 | Dall'Omo | B65D 75/52 206/391 |
| 2008/0078685 | A1 * | 4/2008 | Patterson | B65D 85/07 206/391 |
| 2011/0048994 | A1 * | 3/2011 | Eilert | B65D 75/56 206/391 |
| 2012/0205272 | A1 * | 8/2012 | Heilman | B65D 85/672 206/391 |
| 2021/0053735 | A1 | 2/2021 | Tomioka | |

FOREIGN PATENT DOCUMENTS

| | | | |
|---|---|---|---|
| JP | 2001-294264 | A | 10/2001 |
| JP | 2004-269009 | A | 9/2004 |
| JP | 2019-081568 | A | 5/2019 |
| JP | 2019-116302 | A | 7/2019 |

* cited by examiner

TOILET ROLL PACKAGE

TECHNICAL FIELD

The present invention relates to a toilet roll package in which a plurality of toilet rolls is packaged with a film.

BACKGROUND ART

Toilet rolls, which are rolled elongated toilet papers, are often used in bathrooms with toilet, or in kitchens, living rooms, and the like as substitutes for versatile pop-up tissue paper products or kitchen paper rolls.

On one hand, a plurality of toilet rolls is packaged together with an exterior film so that a plurality of toilet rolls may be stored after purchase.

On the other hand, in most toilet roll packages, a plurality of toilet rolls is packaged as it is with a film. When such products, in which toilet rolls are packaged as they are with a film, are stored in bathrooms with toilet, unused toilet rolls remaining after the package is opened may be prone to be subjected to water from a shower. Further, the products are too bulky to be stored in kitchens or living rooms, or each roll taken out and stored may look poor.

In view of this, among the packages in which a plurality of toilet rolls is packaged together, there are products in which toilet rolls are individually wrapped, and then grouped-packaged together for convenience in use in the bathrooms, kitchens, living rooms, or the like. Such products, however, are bothersome in opening and taking out the rolls, as the toilet rolls are packed doubly.

A toilet roll package is known from Patent Literature 1, in which individually wrapped toilet paper rolls are arranged in two rows between the upper and lower sealed portions of a gusseted package with their circumferential surfaces abutting with each other, and an open start portion is provided in the package by forming a U-shaped or substantially V-shaped line of perforations with its apex facing to the upper sealed portion, so as to form an opening with the open start portion for easy extraction of the enclosed toilet rolls out of the package.

PRIOR ART LITERATURES

Patent Literature

Patent Literature 1: JP 2019-116302 A
Patent Literature 2: JP 2001-294264 A
Patent Literature 3: JP 2591646 Y2

SUMMARY OF THE INVENTION

Problem to be Solved by the Invention

In the gusseted package in which individually wrapped toilet rolls are arranged in two rows between the upper and lower sealed portions with their circumferential surfaces abutting with each other like the package disclosed in Patent Literature 1, the open start portion formed simply by arranging a perforated line in U-shape or substantially V-shape may undergo unintended tearing of the perforated line to open upon impact during product handling or in taking up and carrying the package by the upper-sealed-portion side of the package.

In view of the above, it is a primary object of the present invention to provide a toilet roll package of individually wrapped toilet rolls grouped-packaged together, which is easier to open, allows easier extraction of each toilet roll, and is hard to be opened unintentionally during handling before use.

Means for Solving the Problem

Means for solving the above problems are as follows.

The first means is a toilet roll package comprising a plurality of toilet rolls gusseted-packaged with an exterior film, each of the toilet rolls being individually wrapped with a resin film, wherein the toilet rolls are arranged in two rows between an upper sealed portion and a lower sealed portion of the gusseted package with their circumferential surfaces abutting with each other, the upper sealed portion and the lower sealed portion facing to circumferential surfaces of the toilet rolls, and in that area of the exterior film which is closer to the upper sealed portion than an adjoining position between a pair of toilet rolls located closest to the upper sealed portion, an open start portion generally convexed toward the upper sealed portion is formed, the open start portion including a base portion having an easy tear line extending along a top-bottom direction, and a flaring portion formed with a pair of easy tear lines flaring from close to a lateral side of the base portion toward the lower sealed portion with gradually increasing distance therebetween.

The second means is the toilet roll package according to the first means, wherein the open start portion is formed in an area of a face of the exterior film, the face extending from a face facing to an end face of each toilet roll up to the upper sealed portion.

The third means is the toilet roll package according to the first means, wherein the open start portion is formed in a lateral face of the exterior film located between two faces each facing to either end face of each toilet roll.

The fourth means is the toilet roll package according to first to third means, further including:

a strip-shaped outlet-forming aid portion formed of a pair of easy tear lines each extending from a location continuous from or close to a lower end of either of the easy tear lines forming the flaring portion, toward the lower sealed portion.

The fifth means is the toilet roll package according to first to fifth means, wherein each easy tear line forming the outlet-forming aid portion is a perforated line located above the toilet rolls in either of the two rows, and a width of the outlet-forming aid portion is 0.3 to 1.2 times a diameter of each toilet roll.

Effect of the Invention

According to the present invention, a toilet roll package of individually wrapped toilet rolls grouped-packaged together, may be made easier to open, to allow easier extraction of each toilet roll, and to be hard to be opened unintentionally during handling before use.

DESCRIPTION OF EMBODIMENTS

Figure 1:
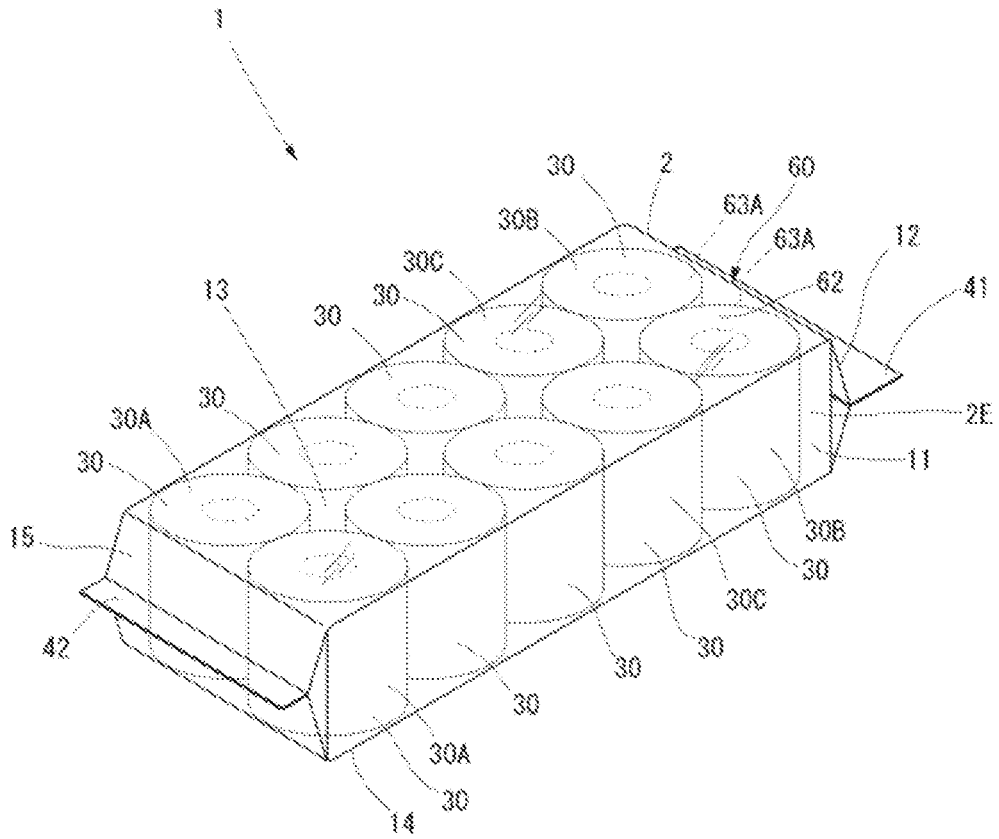
FIG. 1 is a perspective view of a toilet roll package according to an embodiment.
Figure 2:
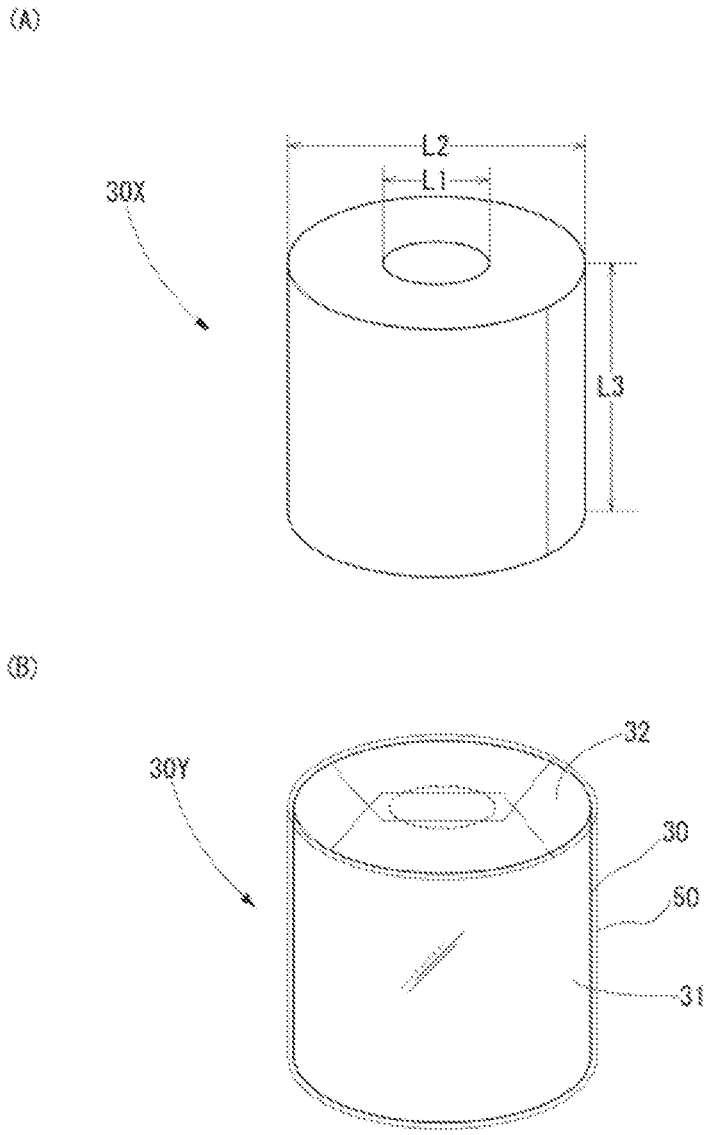
FIG. 2 illustrates toilet rolls according to an embodiment.
Figure 3:
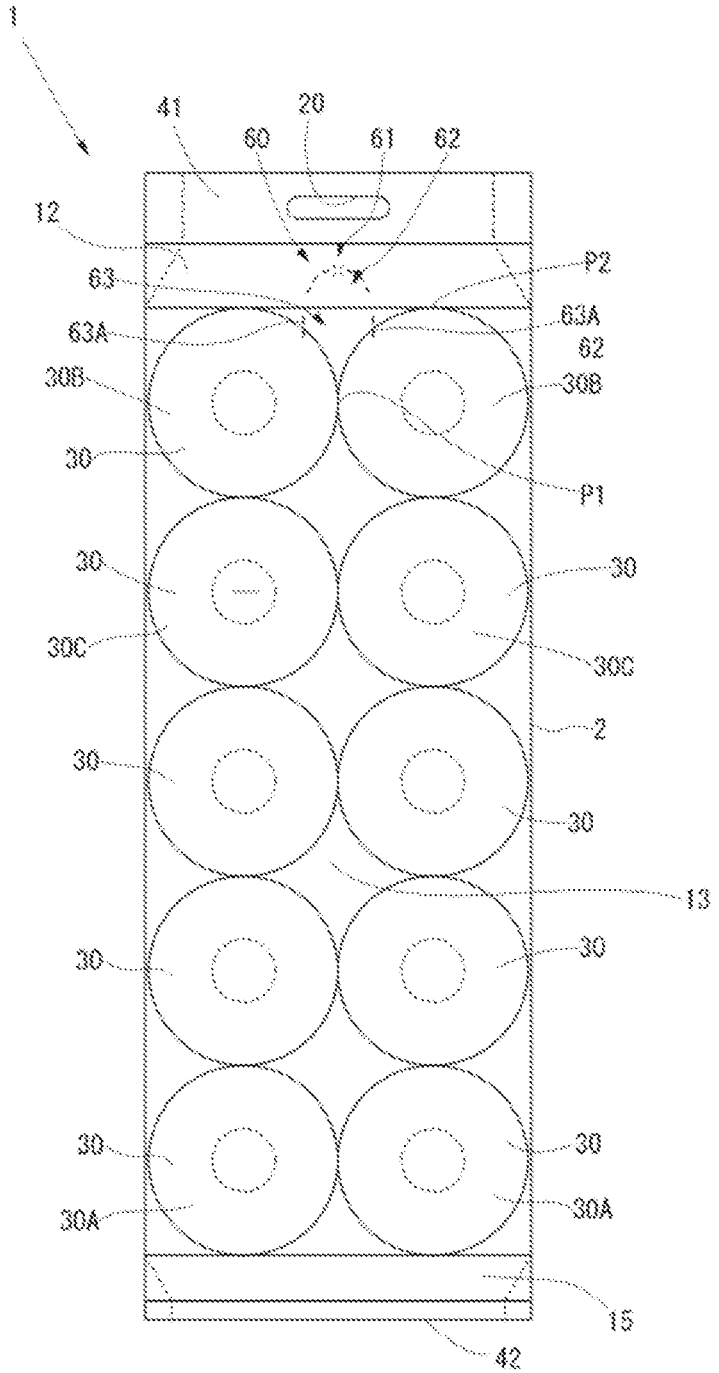
FIG. 3 is a front view for explaining the opening portion according to the first embodiment.
Figure 4:
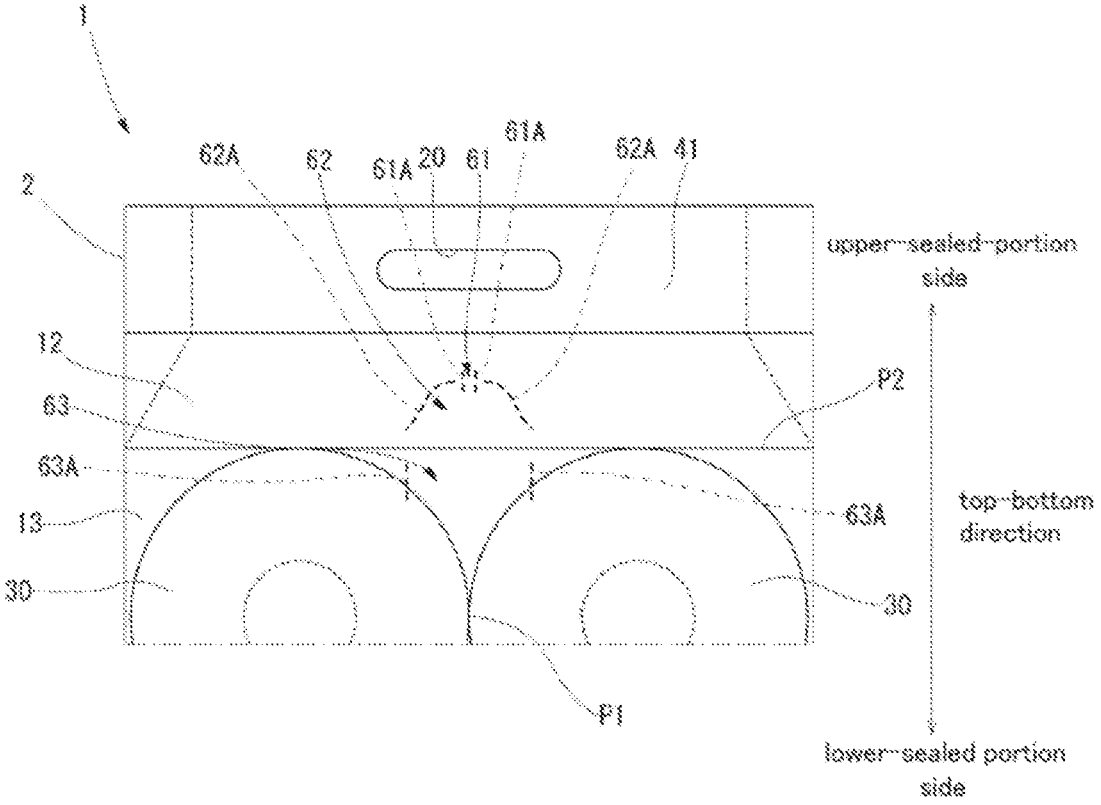
FIG. 4 is another enlarged partial front view for explaining the opening portion according to the first embodiment.

Embodiments of the package according to the present invention will now be discussed in detail with reference to FIGS. 1 to 5.

First Embodiment

A toilet roll package 1 according to the present embodiment is a package of toilet rolls gusseted-packaged with an exterior film 2 (referred to simply as the package hereinbelow).

The gusseted package 1 may be produced, for example, by folding side faces 2E, 2E of a cylindrical exterior film inwards of the bag to flatten the cylinder, sealing the upper portion to form an upper sealed portion 41, opening the lower opening of the gusseted package and placing toilet rolls 30 inside, and sealing the lower portion to close the opening and form a lower sealed portion 42.

The package 1, with the toilet rolls 30 packaged therein, has gussets 11, 11 formed by unfolding the side faces 2E, 2E of the exterior film, which were folded into the flattened state, and faces 12, 13, 14, 15 contiguous to the gussets. Among the faces contiguous to the gussets 11, the face contiguous to the upper sealed portion 41 is referred to as a top face 12, while the face contiguous to the lower sealed portion 42 is referred to as a bottom face 15. The two faces contiguous to the top face 12, the bottom face 15, and the gussets 11, 11 are each referred to as a front face 13 and a back face 14. Note that the front face 13 and the back face 14 are relatively termed, and either face without limitation may be referred to as a front face.

The upper sealed portion 41 and the lower sealed portion 42 are formed by a commonly known sealing technique, such as heat sealing or ultrasonic sealing, with the heat sealing being preferred.

The upper sealed portion of the package 1 is preferably provided with a known type of a finger hole 20 or a slit for forming a finger hole for portability of the package 1.

In this package 1, the toilet rolls 30 are characteristically arranged in two rows between the upper sealed portion 41 and the lower sealed portion 42 of the gusseted package with the circumferential surfaces abutting with each other, and the upper sealed portion and the lower sealed portion are facing to the circumferential surfaces 31 of the toilet rolls. In other words, in the package 1, two rows of the toilet rolls 30 are arranged from the upper sealed portion 41 toward the lower sealed portion 42, and the end faces 32 of each toilet roll 30 are oriented to the front face 13 and the bottom face 14, respectively, of the package 1. The number of the toilet rolls preferably enclosed in this package 1 is two rows of two rolls totaling 4 rolls, two rows of four rolls totaling 8 rolls, two rows of five rolls totaling 10 rolls, or two rows of six rolls totaling 12 rolls. The package 1 is particularly suitable for two rows of five rolls totaling 10 rolls as shown in the figures.

In many of the conventional toilet roll gusseted packages (referred to as conventional package hereinbelow), the enclosed toilet rolls are stacked in a plurality of tiers in the top-bottom direction with the end faces of the toilet rolls oriented toward the upper sealed portion and the lower sealed portion, respectively. With the products, in particular, in which toilet rolls are packaged as they are, this arrangement is employed for facilitating closure of the opening made in the package from near the upper sealed portion for taking out some of the rolls, while the remaining rolls are left in the package formed of the exterior film, to thereby facilitate hygienic storage. In the conventional packages of this arrangement, however, in order to take out the toilet rolls located in the lowermost tier, the other toilet rolls located thereabove should be taken out first.

The package 1 according to the present invention is double packaged, wherein each of the enclosed toilet rolls 30 is individually wrapped with a resin film 50, so that even after the package formed of the exterior film 2 is opened and all the toilet rolls 30 therein are taken out of the package formed of the exterior film 2, the toilet rolls 30 may be stored hygienically. For immediate use, all the toilet rolls are preferably taken out of the package formed of the exterior film 2, but some may be left in the package formed of the exterior film 2. Even in the latter case, as the enclosed toilet rolls 30 are individually wrapped with a resin film 50, the opening in the exterior film may not necessarily be closed. In view of this, with the present package 1, in which the enclosed toilet rolls 30 individually wrapped with a resin film 50 are double-packaged, it is preferred to prioritize readiness of extraction of the toilet rolls out of the exterior film 2, rather than reclosability. In this case, compared to the conventional package arrangement with a plurality of tiers in the top-bottom direction, it is preferred to orient the end faces 32 of each toilet roll 30 in the top-bottom direction and thus facing to the front face 13 and the back face 14, respectively, of the package 1 when the package 1 is placed with the end faces 32 oriented in the top-bottom direction. Thus, the arrangement as in the present package 1 is preferred, wherein the planes formed of the end faces 32 of the toilet rolls 30 are flattened all over so that every toilet roll 30 may readily be reached by a user upon use.

When the package 1 encloses the toilet rolls 30 arranged in two rows between the upper sealed portion 41 and the lower sealed portion 42 with the circumferential surfaces abutting with each other and with the upper sealed portion and the lower sealed portion facing to the circumferential surfaces 31 of the toilet rolls 30 as in the present embodiment, the packages per se may sometimes be stacked in a plurality of tiers during transportation or in stores, or each package may be placed with the circumferential surfaces of the toilet rolls 30A closest to the lower sealed portion down. In such cases, it is preferred that the enclosed toilet rolls 30, in order to make them hard to be collapsed, are rolled slightly more tightly and made into the following figures.

Specifically, the toilet roll 30 is preferably produced by rolling a single- or multi-ply toilet paper having a basis weight per ply of 11 to 25 g/m$^2$ and a paper thickness per ply of 70 to 150 μm, for a length of 20 to 63 m onto a core having a diameter L1 of 36 to 45 mm, so that the diameter L2 of the resulting toilet roll is 100 to 130 mm. The toilet roll 30 rolled in this fashion has sufficient strength in the individually wrapped state, against both collapse in the direction across the end faces and collapse of the circumferential surface, and is particularly suitable for the toilet roll arrangement of the present package 1. Further, with regard to the figure, the toilet roll 30 preferably has a width L3 of 95 to 110 mm. This width L3 of the toilet roll 30 is shorter than the width of common toilet rolls. By imparting a slightly narrower width to the toilet rolls, when the package 1 with the above-discussed arrangement is placed with the front and back faces 13, 14 oriented in the vertical direction, excellent stability is achieved, and extraction of the toilet rolls out of the opening formed by the open start portion 60 to be discussed later, is easier.

The exterior film 2 preferably has a thickness of 40 to 80 μm. Such a thickness of the exterior film 2 is larger than that of the films used for various conventional packages in which the enclosed toilet rolls are stacked in a plurality of tiers in the top-bottom direction with the ends of the toilet rolls oriented toward the upper sealed portion and the lower sealed portion, respectively. With the increased thickness of the exterior film 2, higher strength may be imparted to the overall package, which keeps the toilet rolls 30 from easily collapsing. Further, in particular, with a finger hole 30 formed in the upper sealed portion 41, when the package 1 enclosing the toilet rolls 30 arranged as in the present package 1 is taken up by the finger hole 20 with the upper sealed portion 41 on top, the two rows of the toilet rolls 30 arranged with the circumferential surfaces abutting with each other are line up one on another along the top-bottom direction. In this case, if the exterior film 2 is thin and stretchy, the lines of the toilet rolls in the exterior film 2 tend to be misaligned with about six or more toilet rolls 30, i.e., three or more in each row. On the other hand, the thickness of the exterior film 2 mentioned above may ensure a strength sufficient to hold in the aligned state about five or more toilet rolls in each row. The exterior film 2 may preferably have a melting point of 150° C. or lower for forming the sealed portions. Specifically, the exterior film 2 may preferably be a film made of polypropylene resin or a polyethylene resin in view of cost and tearability. Note that a package film with a lower melting point may be preferred for forming the upper and lower sealed portions 41, 42 as the heat sealing may be performed at a lower temperature, but with an excessively low melting point, the film may disadvantageously be scratched or penetrated due to friction, so that the substantial lower limit is 80° C. A film of a polyethylene resin may be a linear low-density polyethylene (LLDPE) film, a low-density polyethylene (LDPE) film, or a medium-density polyethylene (MDPE) film. Among these, according to the present invention, a linear low-density polyethylene (LLDPE) film layer having a density of about 0.90 to 1.00 g/cm$^3$ and a melting point of 80 to 150° C. is particularly preferred in view of heat sealability and cost. Further, for packaging odorous toilet rolls as the toilet rolls 30, such as those scented, ethylene-vinyl alcohol copolymer resin films or polyethylene terephthalate resin films may be used. Further, one or either side of an ethylene-vinyl alcohol copolymer resin film or a polyethylene terephthalate resin film may be laminated with a film of polyethylene resin or polypropylene resin to form a multi-layer resin film with improved heat sealability.

In the package 1, in an area of the exterior film 2 closer to the upper sealed portion 41 than the position P1 of adjoining between a pair of toilet rolls located closest to the upper sealed portion 41, a characteristic open start portion 60 is formed with easy tear lines. By opening the package from this open start portion 60, an opening is formed in the exterior film 2, which allows quite easy extraction of the enclosed toilet rolls 30.

In the package 1 according to the first embodiment, in particular, in an area of a face of the exterior film 2, which face extends from a face facing to an end face 32 of each toilet roll up to the upper sealed portion 41, i.e., in an area including the top face 12 contiguous from the front face 13 and the back face 14, the open start portion 60 is formed. The open start portion 60 may be provided in one or either of the faces on the front and back sides. In the illustrated embodiment, the open start portion 60 is preferably formed in the middle area between the two rows of the toilet rolls.

This characteristic open start portion 60 according to the present invention includes a base portion 61 having easy tear lines 61A, 61A extending along the top-bottom direction, and a flaring portion 62 formed with a pair of easy tear lines 62A, 62A flaring from a position 62*s* close to the lateral side of the base portion 61A toward the lower sealed portion 42 with gradually increasing distance therebetween, and is generally convexed as a whole toward the upper sealed portion 41.

With such a generally convexed shape, by pressing the open start portion 60, particularly on the base portion 61 or near the lower-sealed-portion 42 side thereof, inwards of the exterior film 2 with a finger or the like, a free-end tab of an easy-to-hold shape is formed. By holding this free-end tab between the fingers and pulling the same from the upper-heat-sealed-portion side toward the lower-heat-sealed-portion 42 side, an opening is readily formed.

The easy tear lines 61A, 62A according to the present invention may, for example, be perforated lines or slit-cut lines having uncut portions, with the perforated lines being preferred. The ratio of the cut portions to the uncut portions (tied portions) in perforated lines or slit-cut lines, i.e., the cut/tie ratio (cut:tie), is preferably 2:1 to 1:3. The length of each cut portion is preferably 1 to 2 mm, which may cause easy tearing of the exterior film 2 upon pressing the open start portion 60 inwards to form the free-end tab.

Here, the open start portion 60 according to the present invention has a generally convexed shape as a whole as discussed above, and the direction of extension of each easy tear line 61A forming the base portion 61 is different from that of each easy tear line 61B forming the flaring portion 62. One end 62*s* of the flaring portion 62 is located close to the base portion 61, but is on the lateral side of the base portion 61 and not continuous to the end 61*s* of each easy tear line 61A forming the base portion 61. Thus, by the action of pressing with a finger or the like, tearing of the easy tear lines 61A, 61A of the base portion 61 and tearing of the easy tear lines 62A, 62A of the flaring portion 62, particularly from the base-portion 61 side, proceed successively to result in easy opening of the package, whereas upon impact during product handling or in taking up or carrying the package by the upper-sealed-portion 41 side thereof, tearing of the easy tear lines 61A, 61A of the base portion 61 is hard to spread successively to the easy tear lines 62A, 62A of the flaring portion 62. Also, in reverse, tearing of the easy tear lines 62A, 62A of the flaring portion 62 is hard to spread to the easy tear lines 61A, 61A of the base portion 61. Accordingly, even if any of the easy tear lines are unintentionally torn during handling before use, such as upon impact during product handling, merely a small slit will result, and a large opening which leads to formation of a free-end tab is hardly formed. In other words, the package is easy to open to form an opening which allows easy extraction of each toilet roll 30, but is hard to be opened unintentionally during handing before use. Further, this open start portion 60 in the package 1 functions particularly preferably with a thicker exterior film 2 as discussed above.

For hindering unintentional spread of tearing of the easy tear lines 61A, 61A forming the base portion 61 successively to the easy tear lines 62A, 62A forming the flaring portion 62, preferably one end 62*s* of each easy tear line 62A forming the flaring portion 62 is located near the middle of the length of either of the easy tear lines 61A forming the base portion 61. Further, for hindering unintentional spread of tearing of the easy tear lines 61A, 61A forming the base portion 61 successively to the easy tear lines 62A, 62A forming the flaring portion 62, the distance between each easy tear line 61A forming the base portion 61 and the base-portion 61 side end 62*s* of each easy tear line 62A forming the flaring portion 62 is preferably 1 to 5 mm.

Here, according to the present invention, one easy tear line 61A for the base portion 61 may be provided in the top-bottom direction, but two easy tear lines 61A, 61A, as in the illustrated embodiment, are preferred. With two easy tear lines, the base portion 61 may be made weaker, successiveness of tearing from one of the easy tear lines 62A forming the flaring portion 62 to the other 62A may be more likely to be lost, intentional opening may be easier, and unintentional tearing may preferably be prevented. Three or more easy tear lines 61A forming the base portion 61 may be provided, but too many easy tear lines 61A may excessively increase the weakness of the base portion 61, and broaden the extent of presence of the easy tear lines in the direction orthogonal to the top-bottom direction, which may disturb smooth successive tearing of the easy tear lines 62A, 62A from the base portion to the flaring portion 62 upon the action of pressing with a finger.

On the other hand, each easy tear line 61A forming the base portion 61 preferably has a length of 2 to 10 mm. Within this range, upon the action of pressing with a finger, tearing occurs not only in the easy tear lines 61A, 61A forming the base portion 61, but is also prone to spread successively to the easy tear lines 62A, 62A forming the flaring portion 62.

The base portion 61 is, for ease of the action of pressing, preferably positioned in an area where no toilet rolls are present immediately below the exterior film, and in particular, within the width L3 of the toilet roll from the position P2 closest to the upper sealed portion on the pair of toilet rolls 30B, 30B located closest to the upper sealed portion. With the base portion 61 in this position, when the upper sealed portion 41 is held in hand and pulled in the direction of the upper sealed portion 41, the inside of the exterior film 2 at the open start portion 61 becomes empty, so that the open start portion may become easier to press in with a finger.

On the other hand, the spaced distance L4 between the pair of easy tear lines 62A, 62A constituting the flaring portion 62 on the base-portion 61 side is preferably 5 to 15 mm. Within this range, upon the action of pressing with a finger, not only the easy tear lines 61A, 61A forming the base portion 61 are torn, but also a pair of easy tear lines 62A, 62A forming the flaring portion 62 are prone to be torn successively, whereas unintentional tearing of one of the easy tear lines 62A forming the flaring portion 62 is hard to spread to the other 62A.

Further, the distance L5 between the pair of easy tear lines 62A, 62A forming the flaring portion 62 on the lower side opposite to the side closer to the base portion 61 (width in the direction orthogonal to the top-bottom direction) is preferably 30 to 100 mm. By forming the free-end tab and then holding between the fingers and pulling the same from the upper-heat-sealed-portion 41 side toward the lower-heat-sealed-portion 42 side, an opening is formed which is sufficiently large for allowing extraction of the toilet rolls 30.

The length L6 of the flaring portion 62 in the top-bottom direction is not particularly limited as long as an open start portion 60 of a size sufficient for a finger to be inserted is to be formed. However, an excessive length may disturb easy opening by pressing, and thus a preferred length L6 is 15 to 30 mm.

Further, the package 1 according to the present invention preferably has an outlet-forming aid portion 63 formed with a pair of easy tear lines 63A, 63A each extending from a location continuous from or close to the lower end of either of the pair of easy tear lines 62A, 62A forming the flaring portion 62, toward the lower sealed portion 42. With the outlet-forming aid portion 63, when the free-end tab, which is formed by tearing the open start portion 60, is held between the fingers and pulled from the upper-heat-sealed-portion 41 side toward the lower-heat-sealed-portion 42 side, the outlet-forming aid portion 63 is successively separated and released from the exterior film to form an opening more easily. For optimizing this advantage, the spaced distance L9 between one end 63*s* of each easy tear line 63A forming the outlet-forming aid portion 63 and the lower end 62*e* of each easy tear line 62A forming the flaring portion 62 is preferably 25 mm or less.

The easy tear lines 63A forming the outlet-forming aid portion 63 may be, for example, perforated lines or slit-cut lines having uncut portions, like the easy tear lines 61A, 62A forming the base portion 61 and the flaring portion 62, respectively, with the perforated lines being preferred. Likewise, the cut/tie ratio (cut:tie), which is the ratio of the cut portions to the uncut portions (tied portions) in perforated lines or slit-cut lines, may preferably be 2:1 to 1:3. The length of each cut portion is preferably 1 to 2 mm.

Each easy tear line 63A constituting the outlet-forming aid portion 63 may be located above the toilet rolls in either of the two rows. The width L7 of the outlet-forming aid portion 63 may be the same as or slightly larger than the width L5 of the flaring portion 62 on the lower-sealed-portion 41 side.

The length L8 of the outlet-forming aid portion 63 in the top-bottom direction is not particularly limited, and may be 3 to 15 mm. With such a length, unintentional tearing scarcely occurs during transportation or carrying by the finger hole.

Here, while each of the toilet rolls 30 in the package 1 is individually wrapped with a resin film 50, the manner of the individual wrapping of each toilet roll 30 with the resin film 50 may be a common individual wrapping of a toilet roll, i.e., wrapping of a toilet roll with a resin film by deforming the resin film onto the contour of the toilet roll for close contact therewith. There is no substantial difference in external dimensions between an individually wrapped toilet roll 30Y and an unwrapped toilet roll 30X, but only the absence/presence of the hollow in the core. Note that the individual wrapping may be mere wrapping of the toilet roll with the resin film 50, but may preferably be individual wrapping sealed with an adhesive or by sealing, such as caramel wrapping as shown in FIG. 2(B).

The resin film 50 for the individual wrapping may be a polypropylene film or a polyethylene film, with a preferred thickness of 15 to 30 μm.

Second Embodiment

Figure 5:
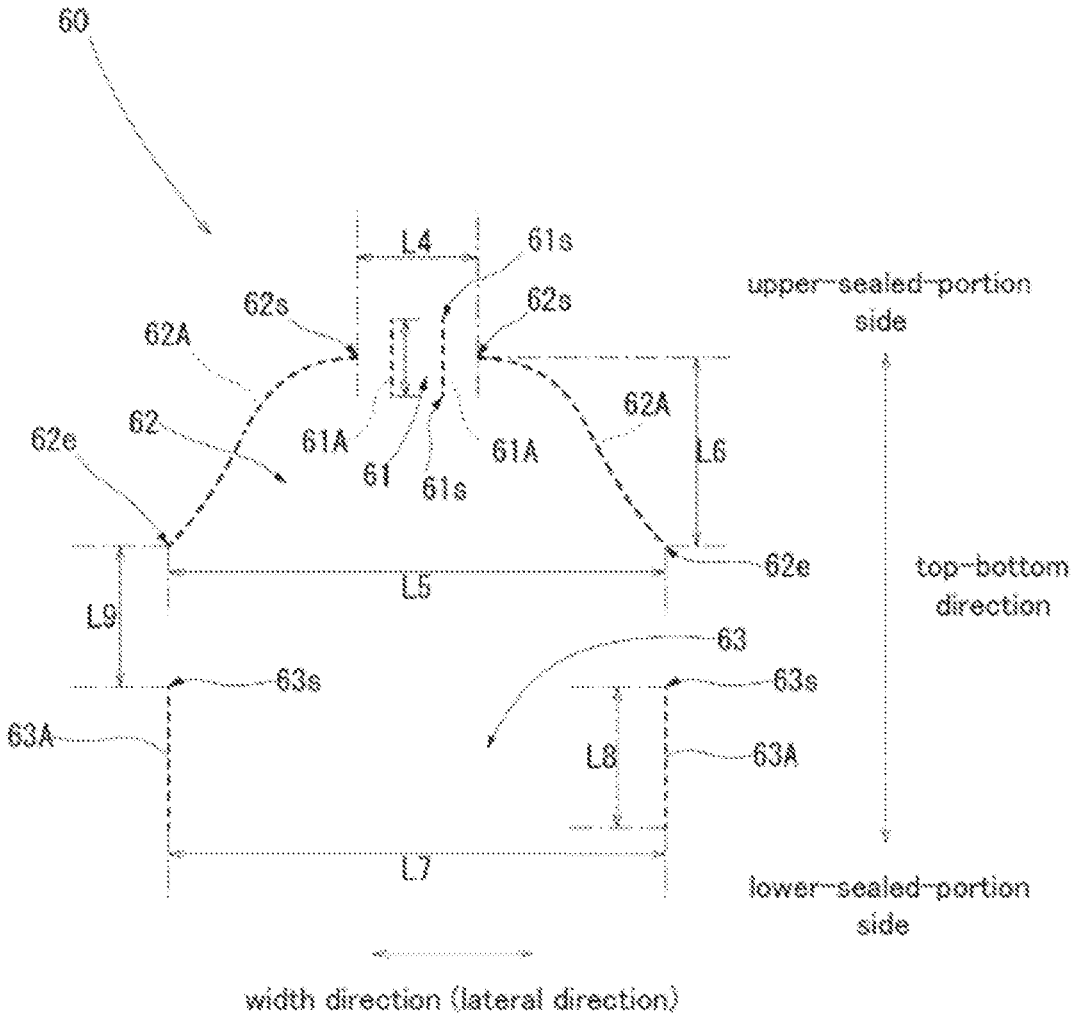
FIG. 5 is a view for explaining the structure of the opening portion according to the second embodiment.
Figure 6:
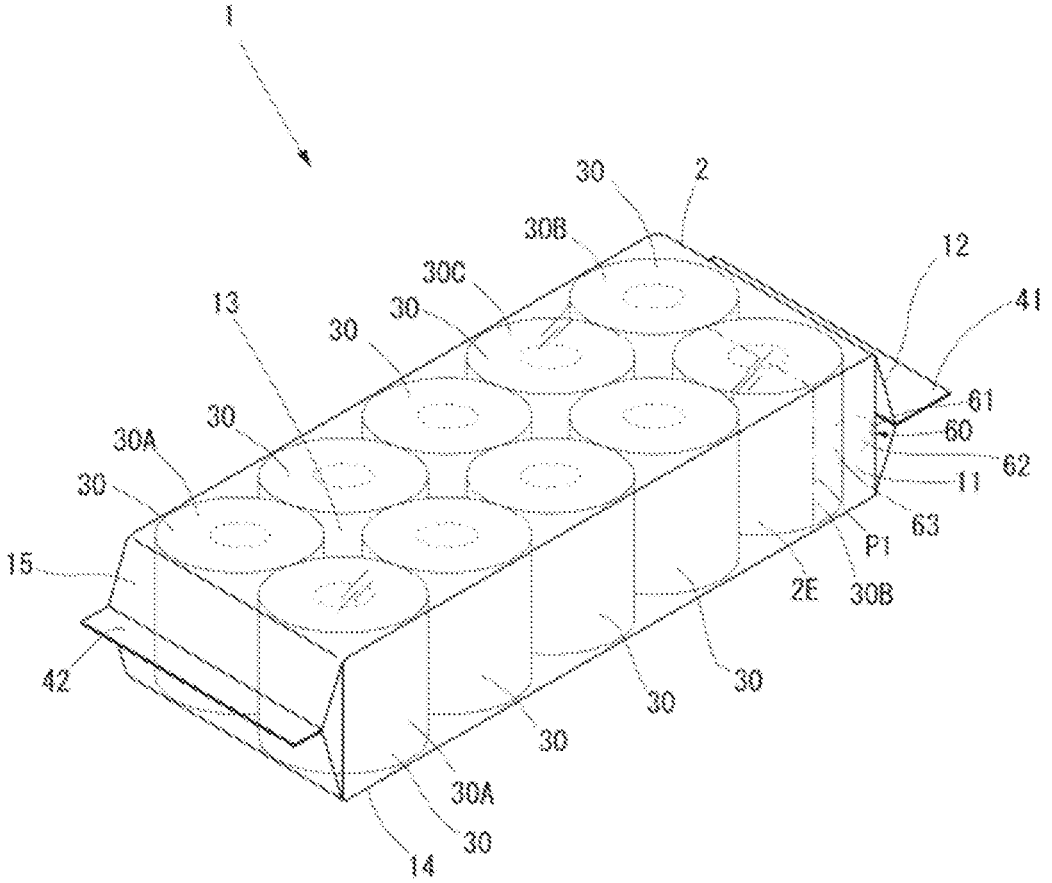
FIG. 6 is a perspective view for explaining the opening portion according to the second embodiment.

Next, the second embodiment will be discussed below with reference to FIG. 5. This second embodiment differs from the first embodiment in face in which the open start portion 60 is provided, with the remaining configuration being the same.

The open start portion 60 according to the second embodiment is formed in a lateral face 11 of the exterior film 2 located between the two faces each facing to either end face 32 of each toilet roll 30, i.e., formed in a gusset 11. By forming the open start portion 60 in a gusset 11, a package may be obtained which is easy to open and provided easily with an opening allowing easy extraction of each toilet roll 30, but is hard to be opened unintentionally during handling before use, as in the first embodiment. The open start portion 60 may be provided in either one or both of the two gussets 11, 11.

DESCRIPTION OF REFERENCE NUMERALS

1: package
2: exterior film
2E: lateral face of exterior film
11: gusset
12: top face
13: front face
14: back face
15: bottom face
20: finger hole
30: toilet roll
30A: toilet roll closest to lower sealed portion
30B: toilet roll closest to upper sealed portion
30C: toilet roll second closest to upper sealed portion
30X: individually unwrapped toilet roll
30Y: individually wrapped toilet roll
31: circumferential surface of toilet roll
32: end face of toilet roll
41: upper sealed portion
42: lower sealed portion
50: resin film
60: open start portion
61: base portion
61A: easy tear line forming base portion
62: flaring portion
62A: easy tear line forming flaring portion
63: outlet-forming aid portion
63A: easy tear line forming outlet-forming aid portion
P1: position of adjoining between a pair of toilet rolls located closest to upper sealed portion
P2: position closest to upper sealed portion on a pair of toilet rolls located closest to upper sealed portion
L1: diameter of core
L2: diameter of toilet roll
L3: width of toilet roll
L4: spaced distance between easy tear lines forming flaring portion on base-portion side
L5: spaced distance between easy tear lines forming flaring portion on a side opposite to base-portion side
L6: length of flaring portion in top-bottom direction
L7: width of outlet-forming aid portion
L8: length of outlet-forming aid portion
L9: spaced distance between easy tear line forming flaring portion and easy tear line forming outlet-forming aid portion

The invention claimed is:

1. A toilet paper roll package comprising a plurality of toilet paper rolls gusseted-packaged with an exterior film, each of the toilet paper rolls including circumferential surfaces and being individually wrapped with a resin film, wherein the toilet paper rolls are arranged in two rows between an upper-sealed portion and a lower-sealed portion of the gusseted package with portions of their respective circumferential surfaces abutting each other, the upper-sealed portion and the lower-sealed portion facing portions of the circumferential surfaces of the toilet paper rolls, and wherein the exterior film includes an open start portion located in an area of the exterior film closer to the upper-sealed portion than an adjoining position of a pair of toilet paper rolls located closest to the upper-sealed portion, said open start portion including a base portion having a pair of easy tear lines each extending in a direction from the upper-sealed portion toward the lower-sealed portion, and a flaring portion having a pair of easy tear lines each originating proximate to the respective lateral sides of the pair of easy tear lines of the base portion and extending in a flaring manner so that the distance between the pair of easy tear lines of the flaring portion gradually increases as the pair of easy tear lines of the flaring portion extend toward the lower-sealed portion, wherein the easy tear lines of the base portion are not contiguous with the easy tear lines of the flaring portion.

2. The toilet paper roll package according to claim 1, wherein the exterior film includes a face portion that extends from a face facing an end face of each toilet paper roll up to the upper sealed portion, where the open start portion is located within said face portion.

3. The toilet paper roll package according to claim 2, further comprising a strip-shaped outlet-forming aid portion formed of a pair of easy tear lines each extending from a location continuous from or close to a lower end of either of the easy tear lines forming the flaring portion, toward the lower sealed portion.

4. The toilet paper roll package according to claim 3, wherein each easy tear line forming the outlet-forming aid portion is a perforated line located above the toilet paper rolls in either of the two rows, and a width of the outlet-forming aid portion is 0.3 to 1.2 times a diameter of each toilet paper roll.

5. The toilet paper roll package according to claim 1, wherein the open start portion is formed in a lateral face of the exterior film located between two faces each facing to either end face of each toilet paper roll.

6. The toilet paper roll package according to claim 5, further comprising a strip-shaped outlet-forming aid portion formed of a pair of easy tear lines each extending from a location continuous from or close to a lower end of either of the easy tear lines forming the flaring portion, toward the lower sealed portion.

7. The toilet paper roll package according to claim 6, wherein each easy tear line forming the outlet-forming aid portion is a perforated line located above the toilet paper rolls in either of the two rows, and a width of the outlet-forming aid portion is 0.3 to 1.2 times a diameter of each toilet paper roll.

8. The toilet paper roll package according to claim 1, further comprising a strip-shaped outlet-forming aid portion formed of a pair of easy tear lines each extending from a location continuous from or close to a lower end of either of the easy tear lines forming the flaring portion, toward the lower sealed portion.

9. The toilet paper roll package according to claim 8, wherein each easy tear line forming the outlet-forming aid portion is a perforated line located above the toilet paper rolls in either of the two rows, and a width of the outlet-forming aid portion is 0.3 to 1.2 times a diameter of each toilet paper roll.

10. A toilet paper roll packaging system comprising:

a plurality of toilet paper rolls individually wrapped with a resin film, each of said plurality of toilet paper rolls having two end surfaces and a peripheral surface;

an exterior film that is sealed to form a gusseted package, said exterior film having an upper-sealed portion located in a top surface, a lower-sealed portion located in a bottom surface, a front surface, a back surface, a first side surface and a second side surface;

wherein the plurality of toilet paper rolls are arranged in two rows within said gusseted package with one of said two end surfaces of each of said plurality of toilet paper rolls facing the front surface of said gusseted package, the other of said two end surfaces of each of said plurality of toilet paper rolls facing the back surface of said gusseted package, and the peripheral surfaces of said plurality of toilet paper rolls abutting each other and at least one of said top surface, said bottom surface, said first side surface, and said second side surface of the gusseted package;

wherein said gusseted package includes an open start portion located in at least one of said front surface, said back surface, said first side surface, and said second side surface, said open start portion located in an area closer to the upper-sealed portion than an adjoining position of a pair of toilet paper rolls located closest to the upper-sealed portion, said open start portion including a first pair of easy tear lines each extending in a direction from the upper-sealed portion toward the lower-sealed portion, and a second pair of easy tear lines each originating proximate to the first pair of easy tear lines and extending in a flaring manner outward toward the lower-sealed portion and the first and second side surfaces, respectively, so that the distance between the second pair of easy tear lines gradually increases as the second pair of easy tear lines extend toward the lower-sealed portion, wherein the first pair of easy tear lines are not contiguous with the second pair of easy tear lines.

* * * * *